United States Patent [19]

Rapp

[11] 4,094,021

[45] June 13, 1978

[54] SWIMMING POOL COVER

[76] Inventor: Robert A. Rapp, 5033 Maiden La., Santa Rosa, Calif. 95405

[21] Appl. No.: 765,419

[22] Filed: Feb. 3, 1977

[51] Int. Cl.[2] ..... E04H 3/16; E04H 3/18

[52] U.S. Cl. ..... 4/172.12; 24/204; 52/3

[58] Field of Search ..... 4/172.12, 172.13, 172.14; 52/3, 4; 24/204

[56] References Cited

U.S. PATENT DOCUMENTS

| | | | |
|---|---|---|---|
| 1,871,570 | 8/1932 | Weber | 52/3 |
| 2,870,454 | 1/1959 | Schippert et al. | 4/172.12 |
| 3,366,977 | 2/1968 | Koehler | 4/172.12 |
| 3,372,438 | 3/1968 | Rinecker | 24/204 X |
| 3,503,101 | 3/1970 | Kolozsvary | 24/204 |
| 3,555,573 | 1/1971 | Turner | 4/172.12 |
| 3,608,099 | 9/1971 | Wall | 4/172.12 |
| 3,711,873 | 1/1973 | Katzman | 4/172.12 |

FOREIGN PATENT DOCUMENTS

| | | | |
|---|---|---|---|
| 911,945 | 12/1962 | United Kingdom | 4/172.12 |
| 915,894 | 1/1963 | United Kingdom | 4/172.12 |

*Primary Examiner*—William D. Martin, Jr.
*Attorney, Agent, or Firm*—Naylor, Neal & Uilkema

[57] ABSTRACT

A pool cover in sheet form is provided with tie members which are connectable to tie-anchoring members which are secured to the side walls of the pool just below the coping. The cover is provided with depending skirt portions around its edges which extend downwardly into the water and serve to prevent the wind from getting beneath the cover to blow it out of position.

1 Claim, 2 Drawing Figures

SWIMMING POOL COVER

SUMMARY OF THE INVENTION

Figure 1:
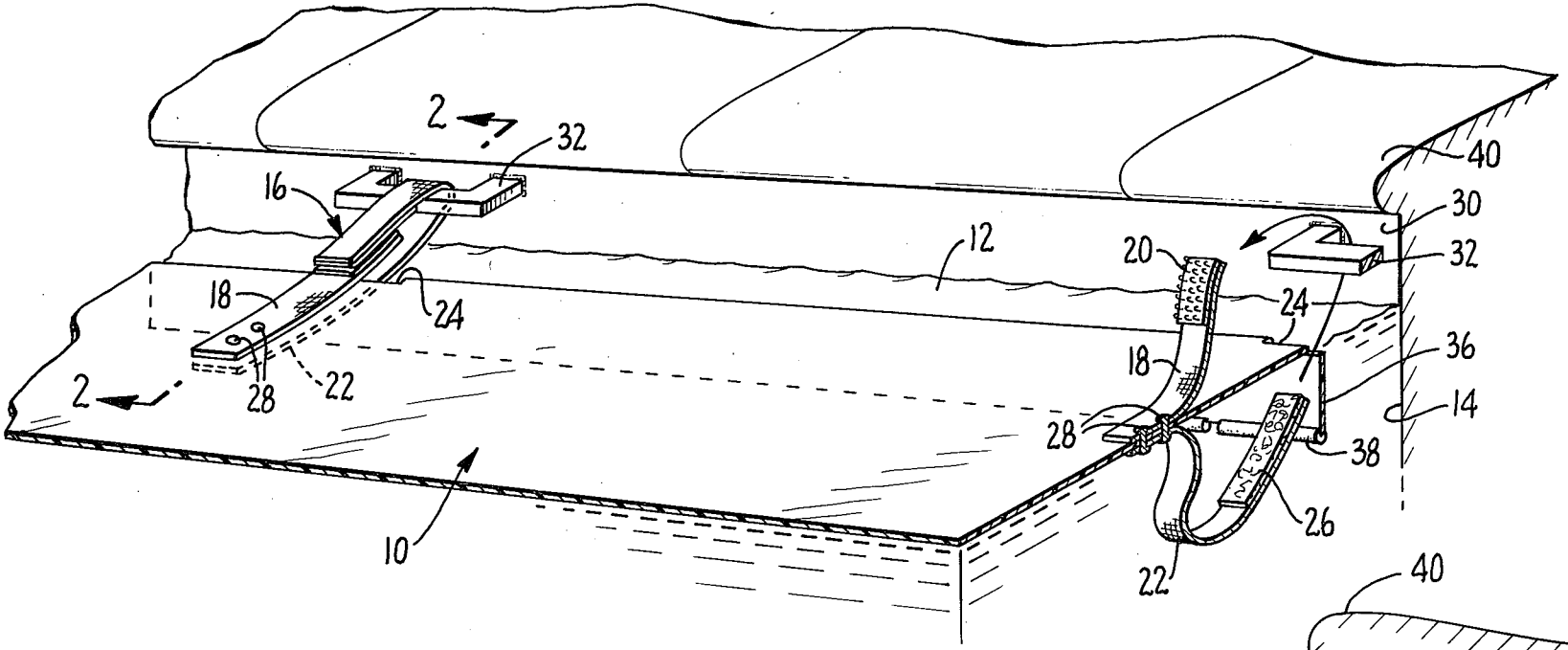

An object of the invention is to provide a pool cover and pool cover anchoring system such that the cover and anchoring system are wholly contained within the pool below the deck of the pool.

A further object of the invention is to provide novel pool cover tie-down means comprising tie or strap members attached to the cover and tie fastening clips attached to the side walls of the pool.

Another object of the invention is to provide a pool cover which is shaped to fit totally within the water surface area of the pool and which is provided with depending skirt portions around one or more of the side edges to prevent the wind from getting beneath the cover.

Figure 2:
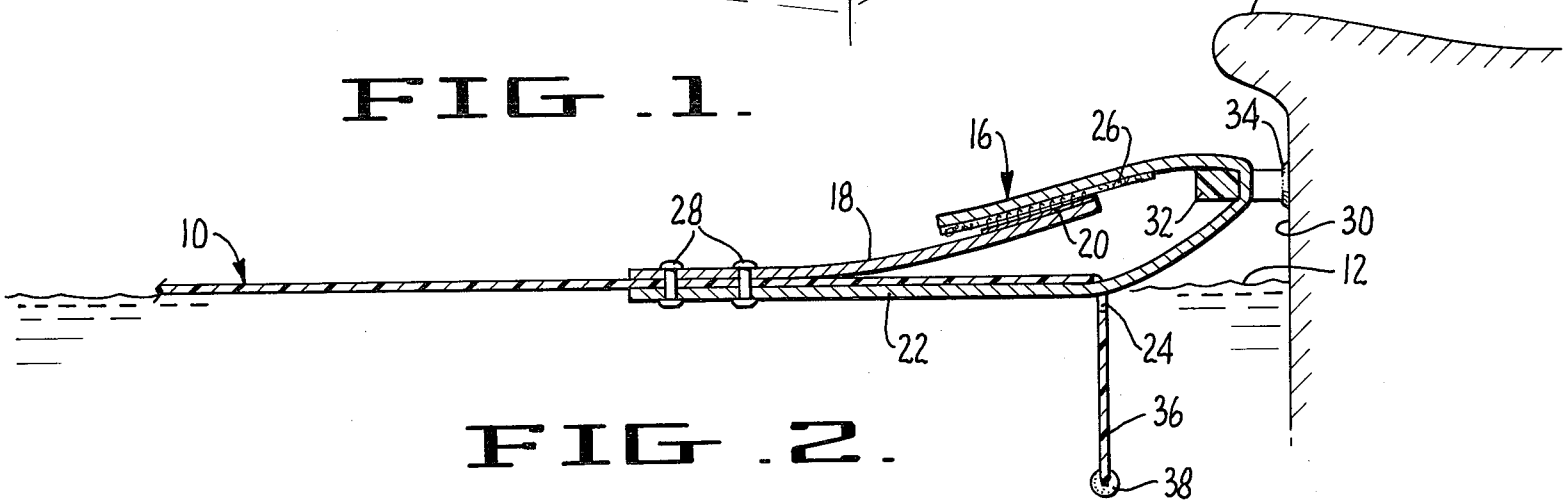

Other objects and advantages of the invention will be apparent from the following description taken in conjunction with the drawing forming part of this specification, and in which:

FIG. 1 is a view in perspective of the improved pool cover of the invention in position within a pool; and FIG. 2 is an enlarged detail view in section taken along lines 2—2 of FIG. 1.

DESCRIPTION OF THE INVENTION

The cover 10 is cut or formed to the shape of the pool. It covers the entirety of the surface of the pool water except for a very narrow periphery 12 of exposed water which extends around the cover. Alternatively, the cover may extend all the way to the pool side wall 14 all around the pool.

The cover 10 is provided at spaced intervals all around its periphery with strap tie means 16 comprising an upper, relatively short tie member 18 having a Velcro fastener 20, a lower, relatively long tie member 22 which extends through a slot 24 formed in the cover 10 and is provided with a Velcro fastener 26 which is adapted to secure itself to the fastener 20, and rivets 28 securing the tie members 18 and 22 to the cover.

The upper tile area 30 of the pool side walls are provided at spaced intervals with U-shaped clip members 32 which are preferably made of any suitable plastic and are secured to the pool side walls by a suitable cement or adhesive 34, such as the commonly used two component epoxy adhesive.

The cover 10 is provided with an integral, depending skirt portion 36 which may extend all around the periphery of the cover or which may be located selectively along that side or portion of the cover which faces into the prevailing wind, the principal function of the skirt portion 36 being to prevent the wind from blowing beneath the cover. The skirt portion 36 is preferably provided with a series of spaced weight members 38 which serve to keep the skirt portion 36 in a submerged or windproof condition.

The strap ties are readily connected together and disconnected when desired. The longer ties 22 are passed through the clips 32 and the Velcro fasteners 20 and 26 are then connected together.

The pool coping 40, when present, extends over the clips 32, thereby protecting the clips to a substantial extent against being broken off during normal pool usage.

The cover 10 may be either floatable or non-floatable. A preferred material for the cover is a polyethylene laminate consisting of a core layer of polyethylene woven scrim laminated with a 1.5–2.0 mil thick polyethylene layer on each side.

The clips and strap ties may be spaced about three feet apart.

In installing the clips 32 along the tile face 30, the latter is roughened with sandpaper at the spots where the clips are to be secured by the adhesive 34.

What is claimed is:

1. A swimming pool cover comprising a flexible pliable plastic sheet having a size and shape to substantially cover the surface of the water within a pool, a plurality of pairs of strap members, each pair having common end portions attached to the sheet and other end portions provided with attachable and disattachable complemental fastening means attachable together to form a closed strap member loop, a clip member for each such loop to secure the same directly to the side wall of the pool below the pool deck, said sheet having means to prevent the movement of air therebeneath when the sheet is in place on the surface of the water in the pool, said means comprising a depending skirt disposed along the periphery of said sheet and adapted to extend downwardly into the pool water while the sheet is supported on the pool water by said strap and clip members, the strap members of each pair being superposed, one above and one below the sheet, rivet means attaching the common ends thereof together, the sheet having a plurality of slots formed therein for the threading therethrough of the strap members below the sheet and subsequent connection of the same to said clip members and attachment together of said complemental fastening means.

* * * * *